US006863466B2

(12) United States Patent
Bühren

(10) Patent No.: US 6,863,466 B2
(45) Date of Patent: Mar. 8, 2005

(54) DETACHABLE COUPLING OF A ROTOR CUP AND ROTOR SHAFT IN AN OPEN-END SPINNING ROTOR

(75) Inventor: Stephan Bühren, Schwalmtal (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/858,613

(22) Filed: May 16, 2001

(65) Prior Publication Data

US 2002/0006830 A1 Jan. 17, 2002

(30) Foreign Application Priority Data

May 16, 2000 (DE) ..... 100 24 020

(51) Int. Cl.[7] ..... F16D 1/10

(52) U.S. Cl. ..... 403/383; 403/DIG. 1; 57/414

(58) Field of Search ..... 464/29; 403/315, 403/359.5, 383, DIG. 1; 57/400, 406, 404, 414

(56) References Cited

U.S. PATENT DOCUMENTS

| | | | | | |
|---|---|---|---|---|---|
| 2,550,775 | A | * | 5/1951 | Clark | 403/DIG. 1 |
| 2,750,828 | A | * | 6/1956 | Wendling | 403/DIG. 1 |
| 3,574,374 | A | * | 4/1971 | Keller et al. | 403/383 X |
| 5,293,921 | A | * | 3/1994 | Marocco | 403/383 X |
| 5,522,606 | A | * | 6/1996 | Pressley et al. | 403/383 X |
| 5,555,715 | A | * | 9/1996 | Paweletz et al. | 57/414 |
| 5,794,430 | A | * | 8/1998 | Grecksch et al. | 57/404 X |
| 5,802,838 | A | | 9/1998 | Bock | |
| 5,957,677 | A | * | 9/1999 | Hill et al. | 403/DIG. 1 |
| 5,967,693 | A | * | 10/1999 | Braaten et al. | 403/383 |
| 6,124,658 | A | | 9/2000 | Coenen | 310/90.5 |

FOREIGN PATENT DOCUMENTS

| | | | | |
|---|---|---|---|---|
| DE | 835 675 | * | 4/1952 | 464/29 |
| DE | 38 15 182 | A1 | 11/1989 | |
| DE | 38 35 037 | A1 | 4/1990 | |
| DE | 43 42 539 | A1 | 6/1995 | |
| DE | 0 808 923 | A1 | 11/1997 | |
| DE | 196 18 027 | A1 | 11/1997 | |
| DE | 0 972 868 | A2 | 1/2000 | |

OTHER PUBLICATIONS

German Search Report, 100 24 020.8, Aug. 18, 2000.
European Search Report, EP 0110 2897, Sep. 5, 2001.

* cited by examiner

*Primary Examiner*—Greg Binda
(74) *Attorney, Agent, or Firm*—Kennedy Covington Lobdell & Hickman, LLP

(57) ABSTRACT

An open-end spinning rotor (3) is supported by its rotor shaft (4) in a spinning-rotor bearing (5) with the rotor shaft (4) detachably connected via a coupling device (29) to a rotor cup (26) such that the rotor shaft (4) remains supported in the spinning-rotor bearing (5) when the rotor cup (26) is removed. The coupling device (29) comprises a magnetic device (30) for fixing rotor shaft (4) and rotor cup (26) axially relative to one another and a mechanical rotational safety mechanism (31) for fixing rotor shaft (4) and rotor cup (26) radially relative to one another.

8 Claims, 3 Drawing Sheets

DETACHABLE COUPLING OF A ROTOR CUP AND ROTOR SHAFT IN AN OPEN-END SPINNING ROTOR

CROSS REFERENCE TO RELATED APPLICATIONS

This application claims the benefit of German Application DE P 10024020.8 filed May 16, 2000, herein incorporated by reference.

BACKGROUND OF THE INVENTION

The present invention relates to an open-end spinning rotor having a rotor shaft and a rotor cup which are detachably connected via a coupling device for removal of the rotor cup while the rotor shaft remains supported in the spinning-rotor bearing.

Most open-end rotor spinning machines currently used in the textile industry have spinning rotors that are supported by their rotor shaft in the bearing nips of a so called support disk bearing assembly and are driven by a tangential belt running the length of the machine. These spinning rotors customarily have the rotor shaft and the rotor cup connected in an almost undetachable manner via a force or press fit. Thus, the spinning rotor assembly of the rotor cup and rotor shaft can be inserted or removed as required, e.g., when worn, from the front of the spinning station through the opened rotor housing.

Moreover, spinning rotors are also known, e.g., from European Patent Publication EP 0 972 868 A2, that are driven by an individual motor and are supported by their rotor shaft in a magnetic bearing arrangement. This magnetic bearing arrangement consists of a front and a rear bearing position that have permanent magnetic rings axially opposite each other. One of these permanent magnetic rings is fastened to the stator of the motor whereas the other permanent magnetic ring rotates with the rotor shaft.

Since the insertion or removal of spinning rotors supported in this manner requires a not insignificant assembly cost, the rotor cup is detachably connected to the rotor shaft in these spinning rotors. That is, the rotor cup can be removed or replaced as required, e.g., when worn or during a batch change, after the loosening of a screw connection without the rotor shaft also having to be removed thereby.

However, the detachable coupling of the rotor shaft and rotor cup by means of a screw connection is not totally satisfactory. It can not always be assured in the case of such screw connections that the rotor cup and the rotor shaft remain sufficiently firmly connected at every point in time, e.g., in particular over the course of rather long running times. In addition, it can be relatively complicated and time-consuming to screw the rotor cup fast to the rotor shaft while the latter remains supported in the magnetic bearing.

In addition to the previously described screw connection, numerous other embodiments of devices for coupling a rotor cup to a rotor shaft are known from the patent literature that make possible a detachable connecting of the rotor cup to the rotor shaft. For example, German Patent Publication DE 38 15 182 A1 describes various coupling variants with a positive or non-positive fit that are intended to assure an unobjectionable and readily detachable fixing of the rotor cup to the rotor shaft. However, the individual coupling variants are, as a whole, constructed in a rather expensive manner and are therefore relatively costly.

A comparable coupling device that is significantly simpler in its construction is described in European Patent Publication EP 0 808 923 A1. This known coupling device is designed in the manner of a clip connection in which one part of the clip connection is arranged on the rotor cup and the other part on the rotor shaft. At least one part of the clip connection is loaded by an elastic element.

Even in the case of the coupling device according to European Patent Publication EP 0 808 923 A1 the replacement of the rotor cup is at least complicated, especially when the rotor shaft remains inserted in the bearing device during this replacement. In addition, this coupling device does not always ensure that the rotor cup will always remain reliably fixed to the rotor shaft even at high speeds of the spinning rotor, particularly after repeated insertions and removal of the rotor cup.

Other coupling devices are known from German Patent Publications DE 38 35 037 A1 and DE 196 18 027 A1. German Patent Publication DE 38 35 037 A1 relates to a mechanical, hydraulic tensioning device with a thin-walled, expandable casing that can be tensioned between the rotor shaft and the rotor cup. German Patent Publication DE 196 18 027 A1 describes a centrifugal-force coupling, i.e., a special coupling element comprises spring-loaded spheres that are pressed outward during the operation of the spinning rotor as a consequence of centrifugal force and fix the rotor cup thereby to the rotor shaft. These coupling devices are also
quite expensive in design and in addition require a high balancing precision on account of the high rotor speeds, which renders the manufacture of such devices quite expensive.

SUMMARY OF THE INVENTION

In view of the above-described state of the art, it is an object of the present invention to provide an improved coupling device for detachably fixing a rotor cup to a rotor shaft which overcomes the problems of the known coupling devices.

The invention addresses this objective by providing an open-end spinning rotor having a rotor shaft and a rotor cup detachably connected via a coupling device which comprises a magnetic device for fixing the rotor shaft and the rotor cup axially with respect to one another solely by magnetic attraction therebetween during spinning operation and a mechanical rotational safety mechanism for fixing the rotor shaft and the rotor cup radially with respect to one another.

The coupling device of the invention is not only relatively simple in its design and therefore quite economical to manufacture but is also very reliable at all times during operation. That is, the magnetic device of the coupling apparatus automatically assures that the spinning cup is always fixed with maximum holding force to the rotor shaft in axial direction while the mechanical rotational safety mechanism prevents any relative rotary motion between the two structural components by means of a positive locking thereof.

In a preferred embodiment, the magnetic device is formed by a permanent magnet fixed to the rotor shaft and by a ferromagnetic attachment on the rotor cup. Such a design has the particular advantage that the relatively expensive part of the magnetic device, namely, the permanent magnet, continues in use even when the rotor cup, that is subjected to wear, has become unusable due to corresponding wear and tear and must be replaced.

Advantageously, the permanent magnet may be arranged in a rotationally symmetric receiving casing that is connected via a force fit to the rotor shaft. The rotor shaft can have a tubular design with the receiving casing gripping with an appropriate shoulder or other attachment in the rotor shaft.

The fixation of the rotationally symmetric receiving casing to the rotor shaft by means of a force fit is a proven joining method that not only makes possible a simple and reliable fixing of the receiving casing, and therewith of the permanent magnet, to the rotor shaft but also assures that no imbalance enters into the rotor shaft.

A positive locking element is arranged in the receiving casing to form, in combination with a corresponding positive locking element on the attachment of the rotor cup, the mechanical rotational safety mechanism. The positive locking element in the receiving casing is designed in a preferred embodiment as an inside polyhedron, preferably as an inside hexahedron. Compatibly therewith, an appropriately designed outside polyhedron arranged on the rotor cup is matably received in this inside polyhedron in the assembled state of the rotor cup and rotor shaft. Advantageously, the receiving casing also comprises a cylindrical bore that corresponds with a compatible guide attachment on the rotor cup. This combination of features results in a rotational safety mechanism that is almost without play, can be easily detached and is, moreover, economical to manufacture.

Further features, advantages and details of the present invention will be described and understood from an exemplary embodiment explained in the following disclosure with reference to the accompanying drawings.

DESCRIPTION OF THE PREFERRED EMBODIMENT

Figure 1:
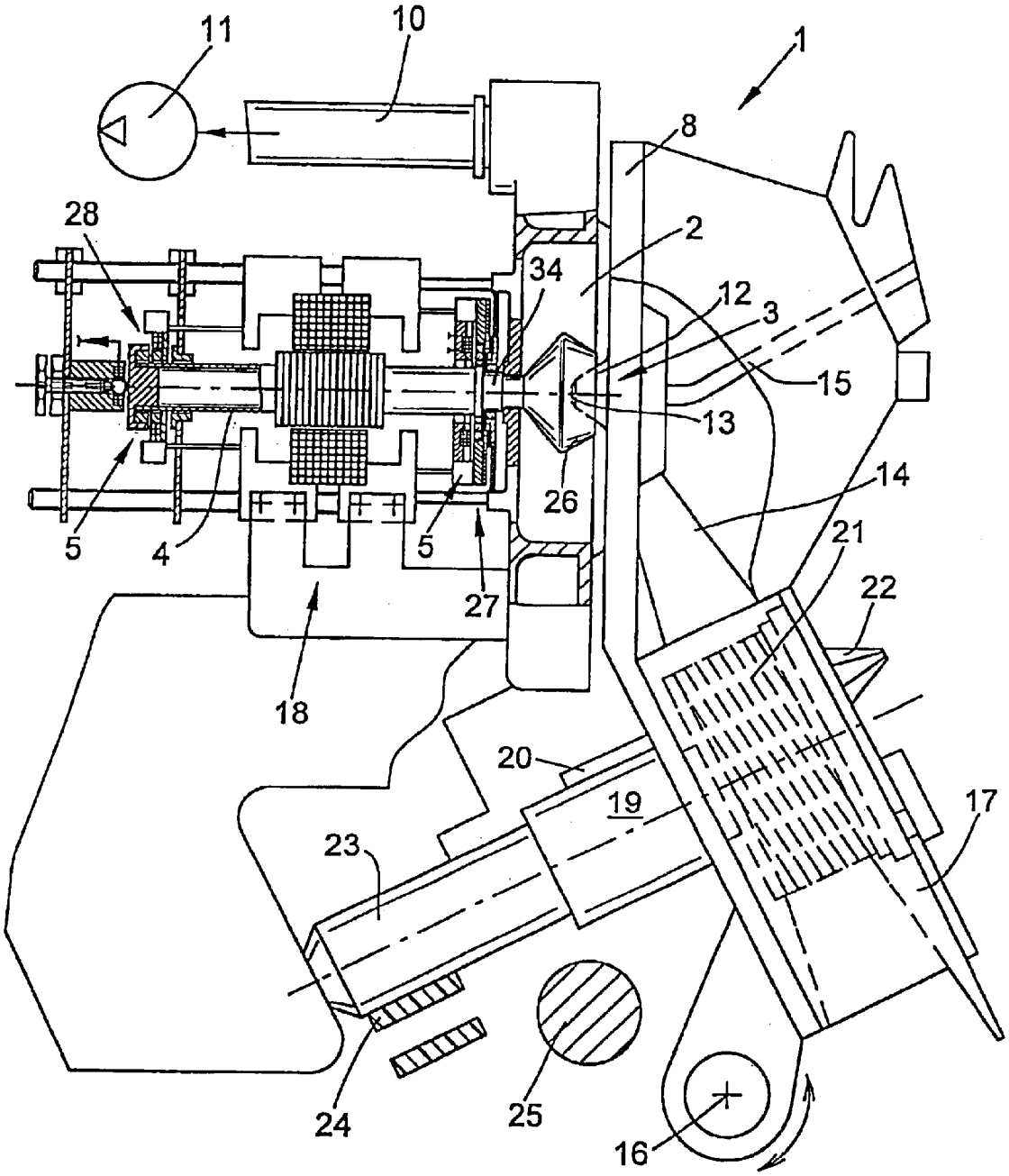
FIG. 1 is a side elevational view, partially in cross-section, of an open-end spinning device with a magnetically supported spinning rotor driven by a single motor and whose rotor cup is connected to the rotor shaft via a coupling device in accordance with the present invention in such a manner that the rotor cup can be easily detached.

Referring now to the accompanying drawings and initially to FIG. 1, the coupling device of the present invention is shown as embodied in an open-end spinning device 1 of the type basically known in principle and already described, e.g., in relative detail in European Patent Publication EP 0 972 868 A2 (U.S. Pat. No. 6,124,658).

Such open-end spinning devices 1 comprise a rotor housing 2 in which a rotor cup 26 of a spinning rotor 3 rotates at a high speed. Spinning rotor 3 is driven by an individual electromotor drive 18 and is fixed by its rotor shaft 4 in front 27 and rear 28 bearing positions of a magnetic bearing arrangement 5, that supports spinning rotor 3 radially and axially.

As is customary, rotor housing 2 is open to the front side of the spinning station and is closed during spinning operation by a pivotably mounted cover element 8 into which a conduit plate (not shown in detail) is inserted. Moreover, rotor housing 2 is connected via an appropriate pneumatic line 10 to a vacuum source 11 that generates the spinning vacuum necessary in rotor housing 2. In addition, a conduit plate adapter 12 is located in cover element 8 or in a canal plate, which adapter comprises yarn draw-off nozzle 13 and a mouth area of a fiber guide conduit 14. Yarn draw-off nozzle 13 is followed by a yarn draw-off tube 15. In addition, an opening cylinder housing 17 is fixed on the cover element 8, supported in such a manner that it can rotate in a limited fashion about a pivot shaft 16.

Moreover, the cover element 8 comprises support brackets 19, 20 on its back side for supporting an opening roller 21 and a sliver delivery cylinder 22. Opening cylinder 21 is driven in the area of its whorl 23 by a tangentially oriented belt 24 traveling the length of the machine whereas the sliver delivery cylinder 22 is preferably driven via a worm drive arrangement (not shown) connected to a drive shaft 25 which extends the length of the machine. In an alternative embodiment opening cylinder 21 and/or sliver draw-in cylinder 22 can of course also be driven by an individual drive, e.g., a stepping motor.

Figure 2:
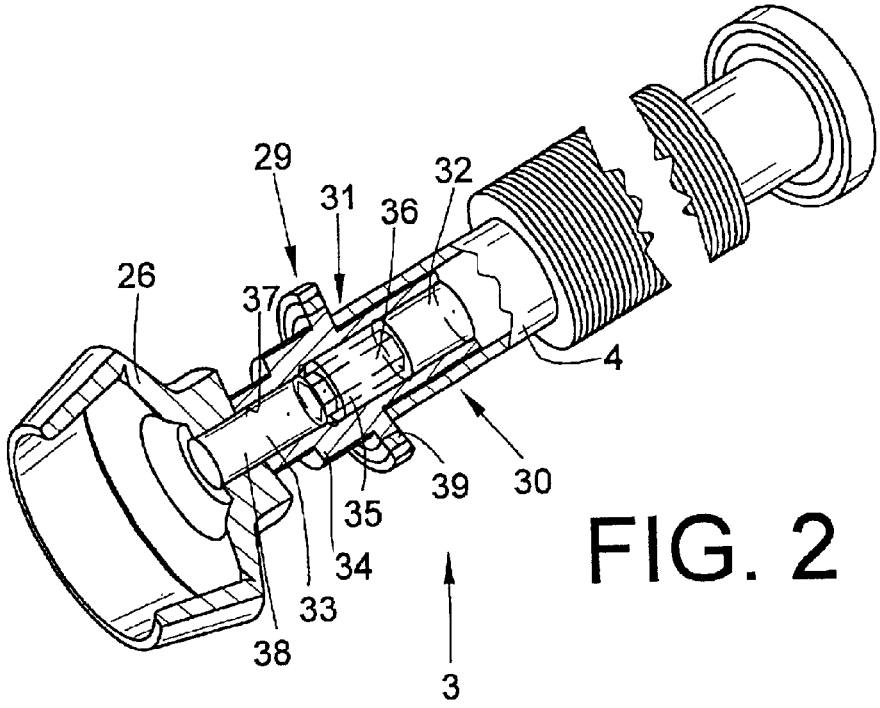
FIG. 2 is a perspective view, partially in cross-section, of the spinning rotor of FIG. 1 showing the rotor shaft connected to the rotor cup via the coupling device of the present invention.
Figure 3:
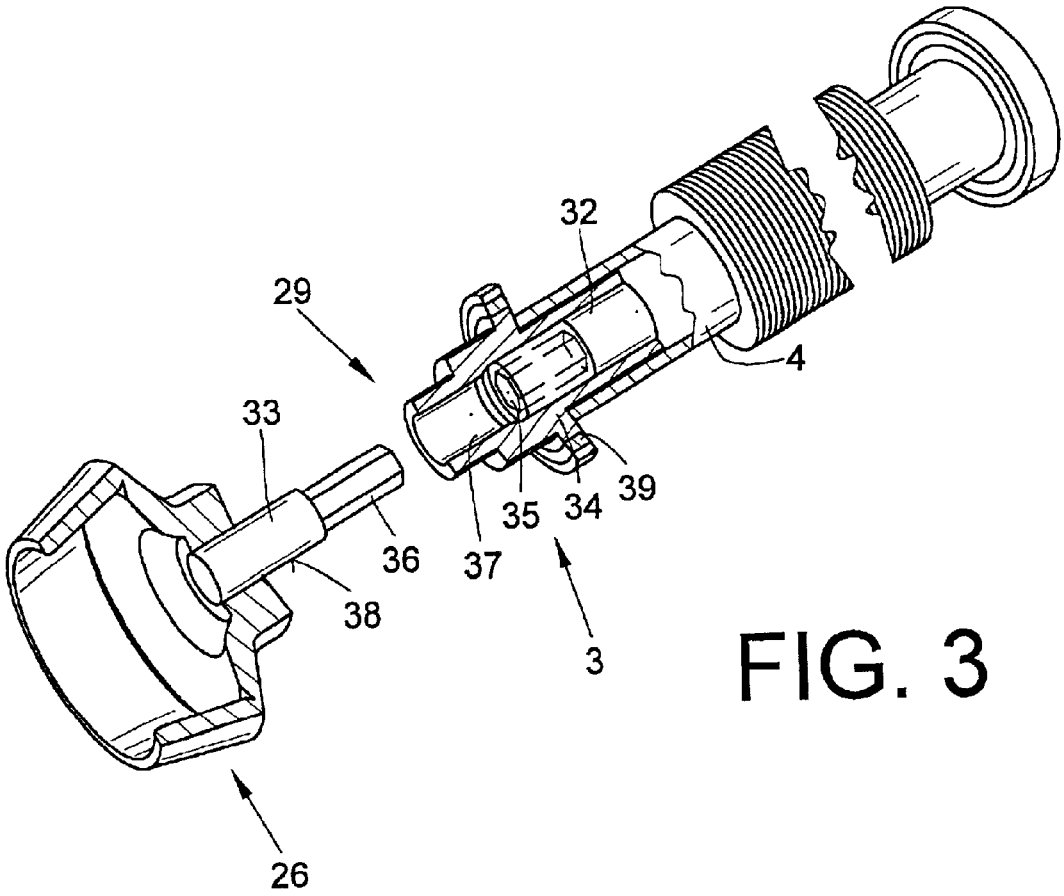
FIG. 3 is another perspective view, partially in cross-section, similar to FIG. 2 but showing the spinning rotor with the rotor cup detached from the rotor shaft.
Figure 4:
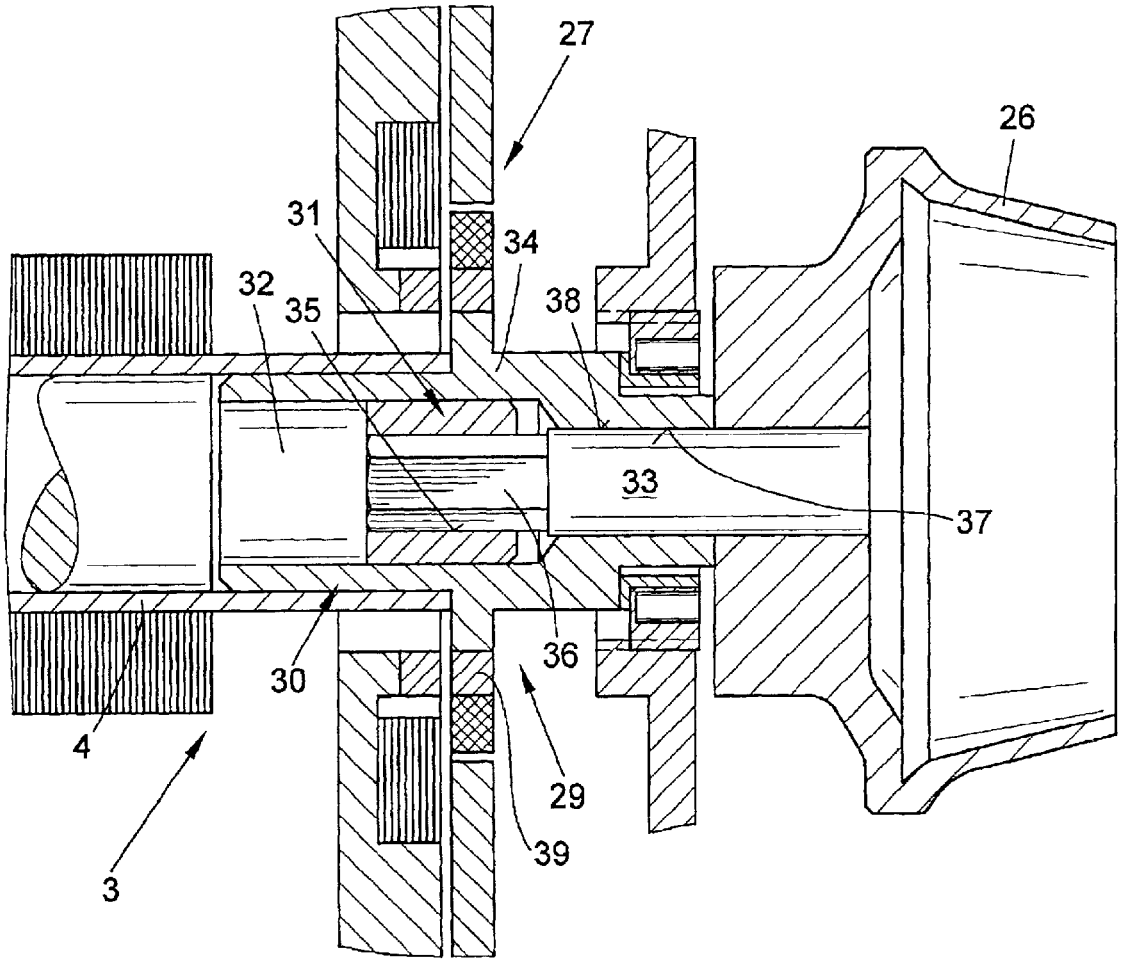
FIG. 4 is an axial cross-sectional view of the spinning rotor of FIG. 1 showing the coupling device in accordance with the present invention in greater detail

With reference more particularly to FIGS. 2 to 4, rotor cup 26 of spinning rotor 3 is connected in an easily detachable magnetic fashion to rotor shaft 4 of spinning rotor 3 via coupling device 29.

Coupling device 29 is comprised specifically of a magnetic device 30 and a mechanical rotational safety mechanism 31. An attachment 33, that is preferably ferromagnetic at least in its end area and divided into two approximately equally long sections 38, 36, is arranged on rotor cup 26. One section connected to the rotor cup 26 is formed as a cylindrical guide attachment 38 followed by an outside polyhedron, preferably outside hexahedron 36. Receiving casing 34 is fixed in preferably tubular rotor shaft 4 via a force fit.

As FIGS. 2 to 4 show in particular, receiving casing 34 comprises not only a permanent magnetic ring 39, on the rotor side, of front bearing position 27 of magnetic bearing arrangement 5 but an inside polyhedron, preferably inside hexahedron 35, as well as permanent magnet 32 are fixed inside receiving casing 34 in such a manner that they rotate in unison. In addition, receiving casing 34 comprises cylindrical bore 37 corresponding in the assembled state to guide attachment 38 of rotor cup 26 such that the casing 34 receives and surrounds the guide attachment 38 without play.

As is shown in FIG. 2 in particular, outside hexahedron 36 on rotor cup 26 and inside hexahedron 35 in receiving casing 34 form a positive-locking rotational safety mechanism in the assembled state for fixing the rotor shaft 4 and the rotor cup 26 radially with respect to one another, whereas the magnetic forces emanating from permanent magnet 32 attract and hold ferromagnetic attachment 33 of rotor cup 26 securely to fix the rotor shaft 4 and the rotor cup 26 axially with respect to one another.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning rotor having a rotor shaft and a rotor cup, the rotor shaft being supported in a spinning-rotor bearing and the rotor shaft and the rotor cup being detachably connected via a coupling device for removal of the rotor cup while the rotor shaft remains supported in the spinning-rotor bearing, characterized in that the coupling device comprises:

a) a magnetic device comprised of a permanent magnet fixed to the rotor shaft by a receiving casing having a cylindrical bore that surrounds a corresponding guide attachment on the rotor cup for fixing the rotor shaft and the rotor cup axially with respect to one another solely by magnetic attraction therebetween during spinning operation, and b) a mechanical rotational safety mechanism comprised of an interior polyhedral receiving area in the receiving casing and a mating exterior polyhedral surface on the rotor cup for fixing the rotor shaft and the rotor cup radially with respect to one another.

2. The open-end spinning rotor according to claim 1, characterized in that said magnetic device comprises said permanent magnet fixed on the rotor shaft and said guide attachment is a ferromagnetic attachment on the rotor cup.

3. The open-end spinning rotor according to claim 2, characterized in that said permanent magnet is received in said casing for connecting to said rotor shaft for unitary rotation therewith.

4. The open-end spinning rotor according to claim 3, characterized in that the casing is fixed on the rotor shaft by a press fit.

5. An open-end spinning rotor having a rotor shaft and a rotor cup, the rotor shaft being supported in a spinning-rotor bearing and the rotor shaft and the rotor cup being detachably connected via a coupling device for removal of the rotor cup while the rotor shaft remains supported in the spinning-rotor bearing, characterized in that the coupling device comprises:

a) a magnetic device comprised of a receiving casing fixed to said rotor shaft having a cylindrical bore that surrounds a corresponding guide attachment on said rotor cup, one of said receiving casing and said guide attachment having a permanent magnet fixed thereto for fixing the rotor shaft and the rotor cup axially with respect to one another solely by magnetic attraction therebetween during spinning operation, and b) a mechanical rotational safety mechanism comprised of an interior polyhedral receiving area in the receiving casing and a mating exterior polyhedral surface on the rotor cup for fixing the rotor shaft and the rotor cup radially with respect to one another.

6. The open-end spinning rotor according to claim 5, characterized in that the other of said receiving casing and said guide attachment is ferromagnetic.

7. A rotor cup for use in an open-end spinning rotor having a rotor shaft supported in a spinning-rotor bearing with the rotor shaft and rotor cup being detachably connected by a coupling device that includes a magnetic device having a permanent magnet fixed to the rotor shaft, said coupling device including a cylindrical bore that includes an interior polyhedral receiving area, said rotor cup comprising a cup portion having an open outer end for receiving textile fibers and for drawing off spun yarn, a hollow interior, a conical wall diverging inwardly from said open outer end, a yarn forming groove at the base of said conical wall, and a guide attachment engageable in said cylindrical bore for fixing the rotor cup axially with respect to the rotor shaft solely by magnetic attraction therebetween during spinning operation, said guide attachment having an exterior polyhedral surface for mating with said interior polyhedral receiving area for fixing the rotor cup rotationally with respect to the rotor shaft.

8. The rotor cup according to claim 7, wherein the polyhedrons are hexagons.

* * * * *